US006232707B1

(12) United States Patent
Ranish et al.

(10) Patent No.: US 6,232,707 B1
(45) Date of Patent: May 15, 2001

(54) WEDGE BASE LAMP

(75) Inventors: Joseph M. Ranish, San Jose, CA (US); Frederick Hetzel, North Royalton; Robert S. McFeely, Valleyview, both of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/207,893

(22) Filed: Nov. 16, 1998

(51) Int. Cl.[7] ..... F21V 19/00

(52) U.S. Cl. ..... 313/318.01; 313/318.09; 313/318.1; 362/226; 362/211; 362/249; 439/611

(58) Field of Search ..... 313/318.01, 318.12, 313/318.09, 318.1; 439/356, 611, 619, 699.2, 375, 226, 220, 232, 227; 362/226, 257, 249, 211

(56) References Cited

U.S. PATENT DOCUMENTS 4,603,278 7/1986 Devir et al. .
4,752,710 6/1988 Devir et al. .
4,979,082 12/1990 Devir .
5,278,741 1/1994 Ehrman .
5,418,698 5/1995 Wu .
5,669,701 9/1997 Lin .
5,785,412 7/1998 Wu et al. .
5,988,830 * 11/1999 Huang ..... 439/619
6,079,848 * 6/2000 Ahroni ..... 439/699.1

* cited by examiner

*Primary Examiner*—Nimeshkumar D. Patel
*Assistant Examiner*—Joseph Williams
(74) *Attorney, Agent, or Firm*—Fay, Sharpe, Fagan, Minnich & McKee, LLP

(57) ABSTRACT

A molded lamp base receives a press seal of a lamp. Internal walls of the base define a cavity open at one end to receive the press seal portion of the lamp. The side walls have a thickness dimension and a width dimension substantially conforming to the peripheral dimensions of the press seal portion. At least one raised bead extends inwardly from the cavity side wall and is dimensioned for a friction fit with the periphery of the lamp to hold the lamp securely in base. In one embodiment, the beads are located in semi-circular recesses disposed about the exhaust tube portion of the lamp while in another embodiment, the beads are spaced outwardly therefrom.

21 Claims, 3 Drawing Sheets

WEDGE BASE LAMP

BACKGROUND OF THE INVENTION

This invention pertains to the art of lamps, and more particularly, to lamps having a press seal. The invention is particularly applicable to an automotive or miniature type incandescent lamp and will be described with particular reference thereto. However, it will be appreciated that the invention may be advantageously employed in related lamp environments and applications where it is important to hold the press seal within a base cavity without using a bonding material such as an adhesive or cement.

U.S. Pat. Nos. 4,603,278; 4,752,710; and 4,979,082 generally relate to electric lamps of the type at issue here where a press seal is formed at one end of the envelope and is received in a cavity of a molded plastic base member. A pair of lamp leads extend outwardly from the press seal and through an opening in the base. The leads are typically bent back along an external wall of the base for establishing electrical connection with contacts of an associated fixture.

Although the noted patents provide proposed solutions to relieve stress in the press seal of the lamp in the plastic base, there is still a problem of holding the press seal securely within the base cavity without using any adhesive. This goal must be accomplished in an inexpensive, practical manner that is easily repeatable and easy to manufacture. It must also be highly reliable, i.e., maintain the lamp in the base.

Stable positioning of the lamp relative to the base maintains the individual components in the desired positions. This, in turn, leads to precise electrical contact, durability, and longer lamp life. Accordingly, the need exists to achieve these various objectives in a lamp assembly.

SUMMARY OF THE INVENTION

The present invention contemplates a new and improved lamp base adapted to receive a press sealed lamp that overcomes the noted problems and yet provides a simple, economical structure that is highly reliable.

According to the invention, the base includes a wall having a cavity open at one end for receiving a press seal portion of the lamp. Facing walls of the cavity each include a curvilinear recess that accommodates an exhaust tube portion of the lamp. The cavity is dimensioned to substantially conform to the peripheral dimensions of the press seal. In addition, at least one raised bead extends inwardly into the cavity from the facing walls and is dimensioned for friction fit with the periphery of the lamp.

According to another aspect of the invention, the beads extend in a substantially continuous fashion from the open end to a closed end of the cavity.

According to another aspect of the invention, the raised beads are disposed in the curvilinear recess to restrain the lamp against movement in both the thickness and width directions.

According to another aspect of the invention, the beads are disposed closely adjacent the recesses and restrain the press seal of the lamp against movement in the thickness direction.

A principal advantage of the invention is found in the simple manner of securing the press seal of the lamp base.

Yet another advantage of the invention resides in the ease with which the components may be manufactured.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in the specification. The embodiments are illustrated in the accompanying drawings which form a part of the invention and wherein.

DETAILED DESCRIPTION OF THE PREFERRED EMBODIMENTS

Figure 1:
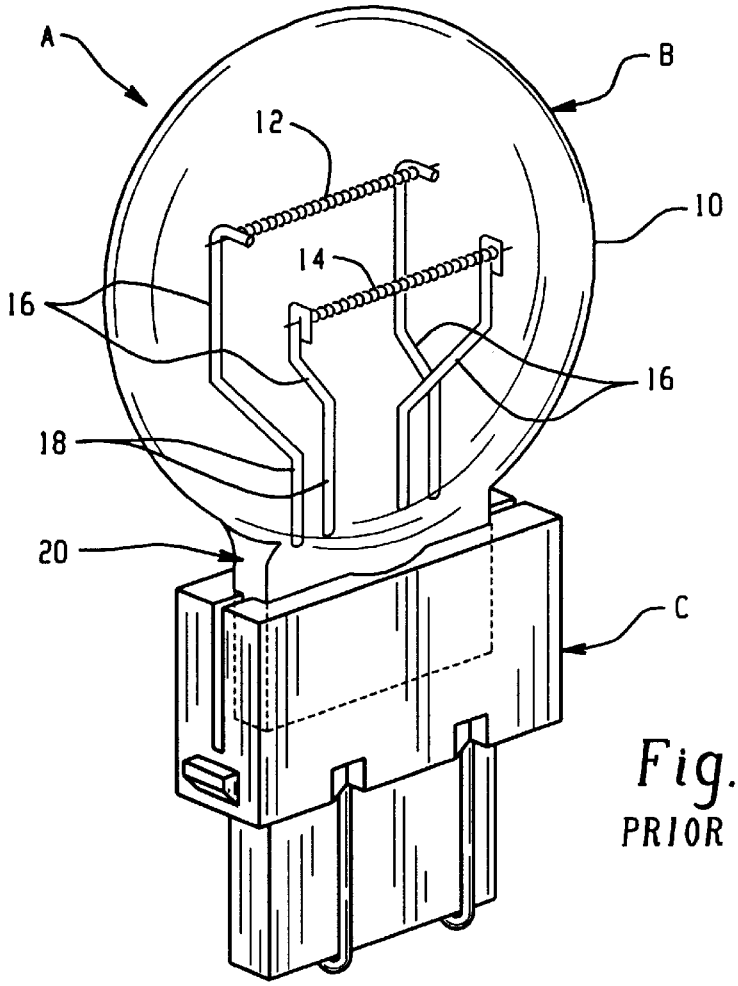
Fig. 1 PRIOR ART
FIG. 1 is an isometric view of a prior art lamp and base assembly.

Referring now to the drawings wherein the showings illustrate the preferred embodiments of the invention only and are not intended to limit the invention, the Figures show a lamp assembly A that includes a lamp B received in a molded base member C also known as a parallelpiped base member. More particularly, and with reference to the prior art of FIG. 1, a generally spherical envelope 10 encloses first and second filaments 12, 14, although it will be understood that the present invention is not limited to a dual coil lamp configuration. The filaments or coils are supported in the envelope by lead wires 16. The lead wires support opposite ends of the coils and also carry the required electrical current so that the coils serve as a light source for the lamp. Opposite or lower ends 18 proceed outwardly from the envelope 10. The lead wires are hermetically sealed to the envelope in a press seal region 20 of the envelope. As is conventional in the art, the envelope is softened at its lower end in the press seal region, and a mechanical deforming or pressing operation is completed on the base of the envelope. This provides a hermetic seal around the lead wires as they exit the envelope so that desired atmospherical integrity is achieved with the incandescent lamp.

Figure 2:
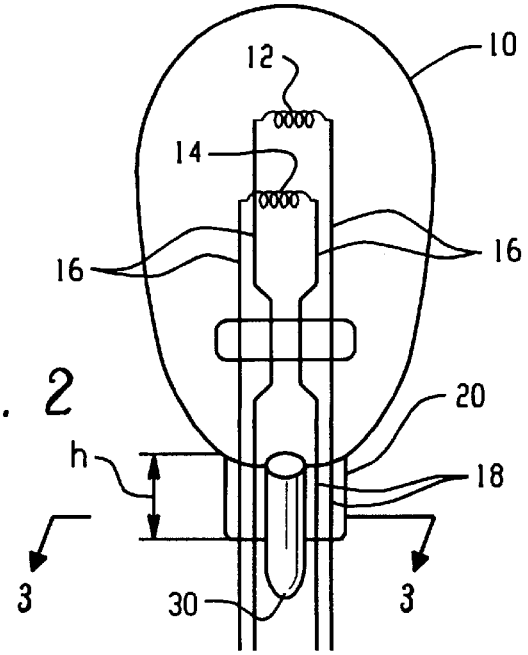
FIG. 2 is an elevational view of the lamp type incorporated into the assembly of FIG. 1.
Figure 3:
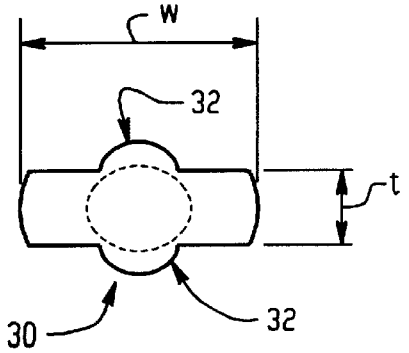
FIG. 3 is a cross-sectional view taken generally along the lines 3—3 of FIG. 2.

A central portion of the press seal region encloses an exhaust tube 30 (FIGS. 2 and 3). The exhaust tube is typically of a diameter slightly larger than the thickness of the press seal region so that it defines semi-circular portions 32 along opposite sides of the press seal region. The semicircular portions 32 extend along the entire height of the press seal. As is well known in the art, the exhaust tube is used to establish the proper atmosphere into the lamp envelope after which it is tipped off or sealed to maintain the desired environment for lamp reliability. Thus as illustrated in FIGS. 2 and 3, the press seal region has a predetermined width "w", a predetermined thickness "t", and a predetermined height "h." With reference again to FIG. 1, the lamp is received in a molded plastic base C, which typically receives only the press seal region of the lamp.

Figure 5:
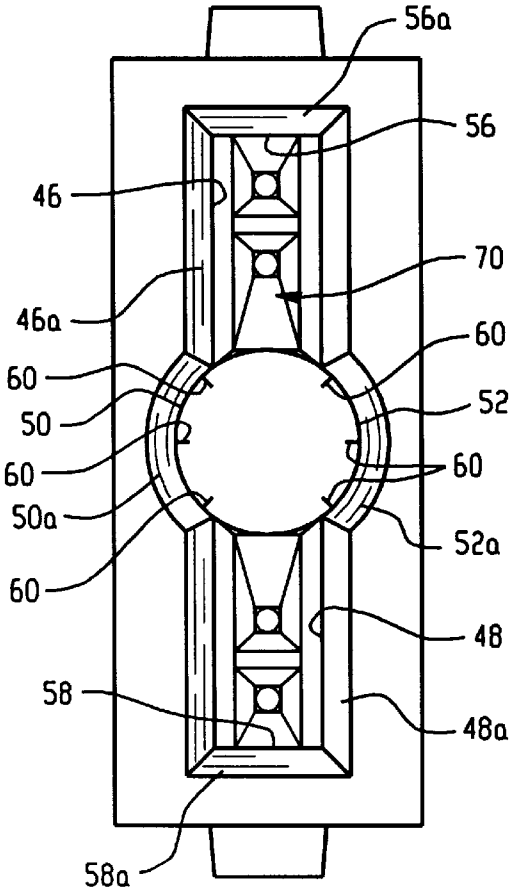
FIG. 5 is a top plan view of the embodiment of FIG. 4.
Figure 4:
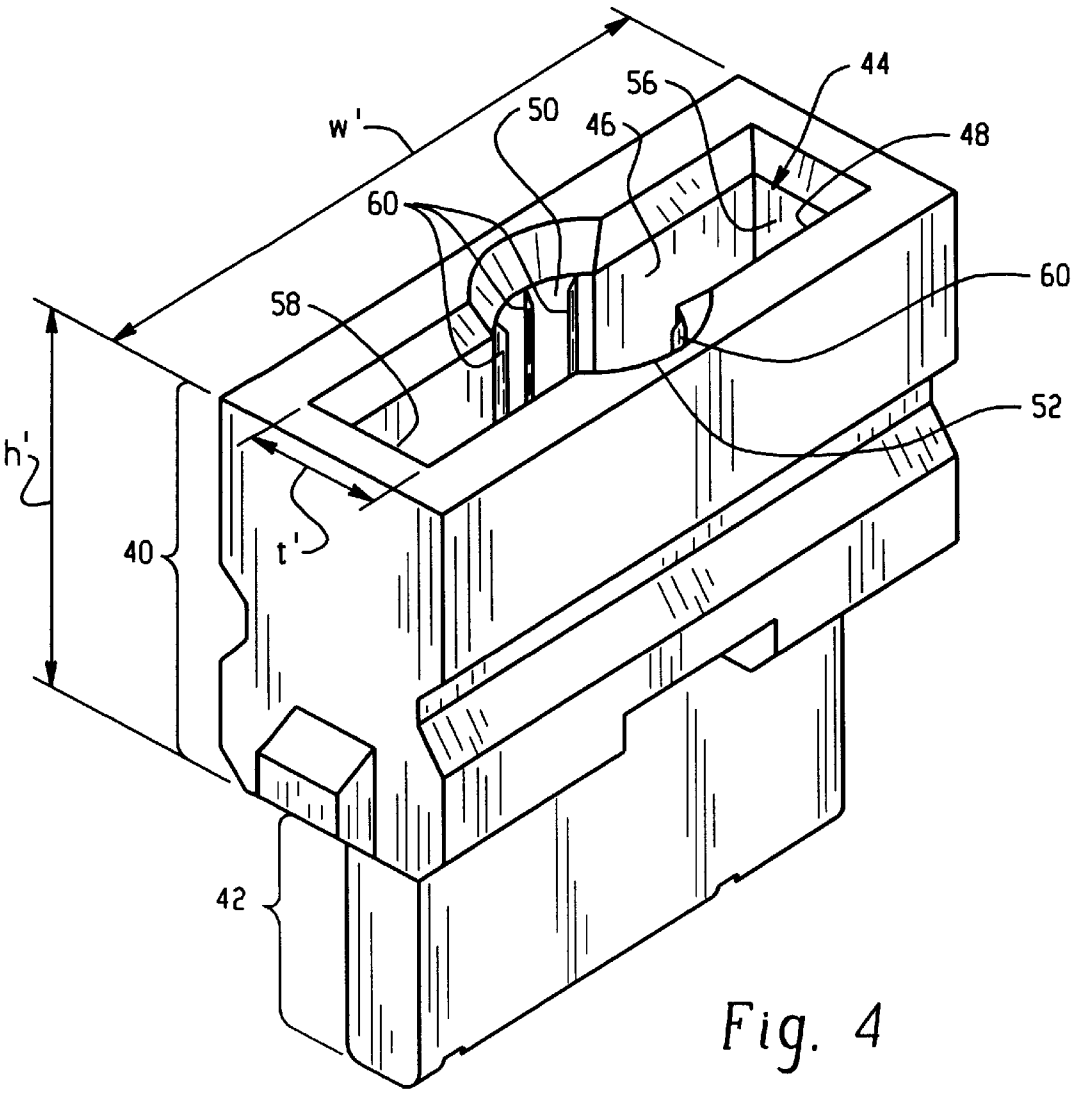
FIG. 4 is a perspective view of a first embodiment of a new base formed in accordance with the teachings of the subject invention.

Turning to FIGS. 4 and 5, a first preferred embodiment of the base is illustrated. It includes an upper portion 40 and a lower portion 42 which is inserted into a lamp holder (not shown). The upper portion 40 has a cavity 44 that receives the press seal of the envelope. The cavity 44 is substantially identical in dimension to the press seal region of the lamp envelope that it receives. That is, it has a predetermined width "w'", a predetermined thickness "t'", and a predetermined depth or height "h'". As illustrated in FIG. 4, and perhaps best illustrated in FIG. 5, the cavity 44 is defined by parallel side walls 46, 48 and 56, 58. The upper edges of each of these side walls is defined by a tapered region denoted by the "a" which facilitates alignment during insertion of the lamp into the base. Likewise, the curvilinear recesses 50, 52 include tapered lead end regions 50*a* and 52*a*. Moreover, walls 46, 48 include curvilinear recesses 50, 52, respectively, which are adapted to conform about the exhaust tube of the lamp. Again, the curvilinear recesses 50, 52 are intended to closely conform to the semi-circular ridges formed by the exhaust tube in the press seal region.

In accordance with the present invention, a means for securing the lamp into the base is particularly provided by a series of ridges or fins located at predetermined locations along the side walls that define the base cavity. Particularly, in the embodiment of FIGS. 4 and 5, six beads or ridges 60 are shown. Here, the beads extend the full height of the cavity and are disposed along the curvilinear recesses 50, 52. That is, they protrude inwardly into the cavity from the remainder of the side wall so as to frictionally engage the outer surface of the press seal region of the lamp. The beads are generally equally spaced along the semi-circular wall regions 50, 52 and restrict the motion of the press seal of the lamp in both the thickness direction and the width direction. That is, the beads engage the area where the exhaust tube is enclosed in the press seal region. The fins are designed with a minimum amount of material so that they deform and also hold the press seal firmly upon insertion into the base. In this embodiment, the fins have a generally triangular cross-section, although it should be understood that still other cross-sectional conformations may be used without departing from the scope and intent of the invention.

Figure 7:
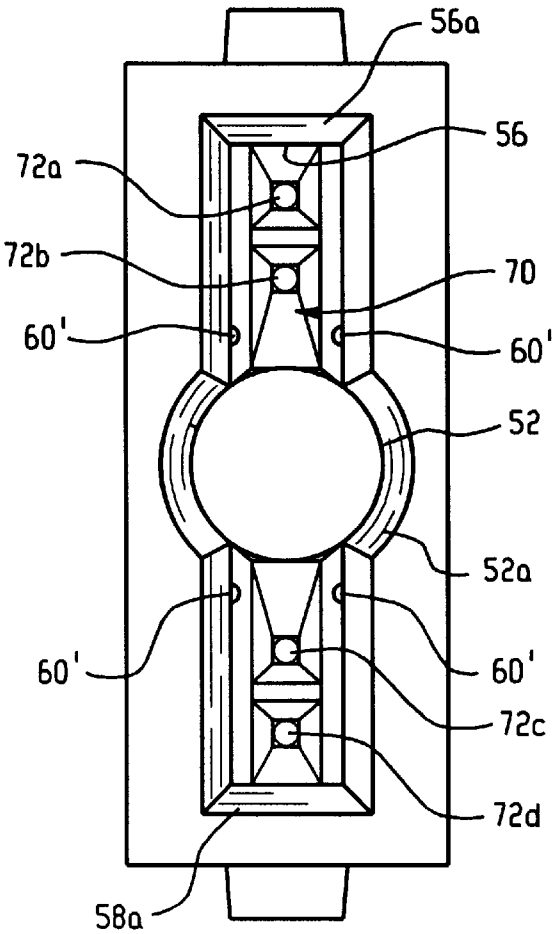
Figure 6:
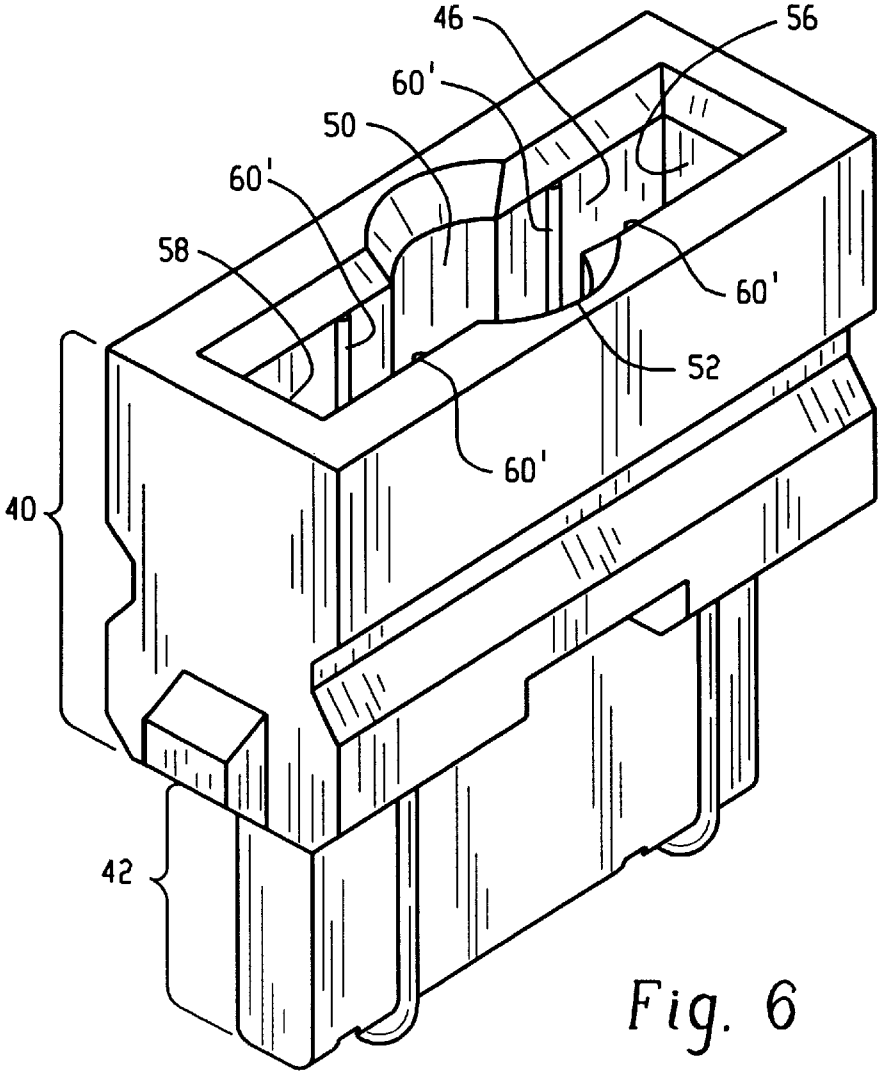
FIG. 6 is a perspective view of a second preferred embodiment of the subject invention; and, FIG. 7 is a top plan view of the embodiment of FIG. 6.

FIGS. 6 and 7 illustrate a second preferred embodiment in which the beads or fins are located in a different region in the base cavity. Particularly, the beads 60' are disposed along the facing walls 46, 48 that define the cavity. Again, the beads or ridges preferably extend the full height of the cavity along the planar region of the side walls. As perhaps best illustrated in FIG. 7, the beads 60' have a semi-circular cross-section intended to fix the press seal against motion mainly in the thickness direction. Motion in the width direction is restrained by friction with the beads. Preferably, the beads are more closely disposed adjacent the semi-circular recesses 50, 52 than to the end walls 56, 58. In substantially all other respects, the embodiment of FIGS. 6 and 7 is similar to that of FIGS. 4 and 5.

Again with reference to FIGS. 5 and 7, a lower wall 70 formed in the base and defining the lower end of the cavity has various tapered regions disposed about four openings 72*a*, 72*b*, 72*c*, 72*d*. The openings are intended to receive the lead wires 16 therethrough so that appropriate connection can be made after they pass through the lower portion 42 of the base. Particular details of those connections are already known in the art, thus requiring no further discussion herein with respect to the present invention.

The above described embodiments allow for a secure connection between the lamp and the base so that it may be secured against movement without the use of an adhesive. Moreover, it is particularly adapted to economical manufacture and assembly while achieving quality results.

The invention has been described with reference to the preferred embodiments. Obviously, modifications and alterations will occur to others upon a reading and understanding of the specification. It is intended to include all such modifications and alterations so far as they come within the scope of the appended claims or the equivalents thereof.

Having thus described the invention, it is now claimed:

1. A lamp base adapted to receive a press seal of a lamp comprising:

a wall having a cavity open at one end and having a substantially rectangular cross-section for receiving a press seal portion of a lamp, the cavity having a thickness dimension and a width dimension substantially conforming to peripheral dimensions of a press seal portion, and a curvilinear recess formed along facing walls of the cavity enlarging the width of the cavity along the recesses to accommodate an exhaust tube portion of the lamp, and at least one raised bead extending into the cavity from at least one of the facing walls and dimensioned for frictionally engaging and retaining the lamp along the exhaust tube portion to hold the lamp in the base.

2. The lamp base of claim 1 wherein the at least one raised bead extends substantially continuously inward into the cavity from the open end to a base of the cavity.

3. The lamp base of claim 2 wherein the at least one raised bead extends in a generally linear fashion.

4. The lamp base of claim 1 wherein each of the facing walls includes at least one raised bead extending into the cavity for frictionally retaining the periphery of the lamp.

5. The lamp base of claim 1 wherein the one end of the cavity includes a perimeter taper that narrows as it extends inwardly into the cavity for facilitating receipt of a press seal into the cavity.

6. The lamp base of claim 1 wherein the at least one raised bead is located along each of the facing walls more closely adjacent the curvilinear recesses than to the remaining walls defining the cavity.

7. The lamp base of claim 6 wherein the at least one raised bead has a generally semicircular cross-section.

8. The lamp base of claim 6 wherein the at least one raised bead has a generally triangular cross-section.

9. The lamp base of claim 1 wherein the at least one raised bead has a generally semicircular cross-section.

10. The lamp base of claim 1 wherein the base further includes a lampholder portion extending outwardly from the base in a direction opposite the one end of the cavity, the lampholder portion dimensioned for receipt in a lampholder.

11. The lamp base of claim 10 wherein the lampholder portion has a reduced cross-sectional dimension relative to the remainder of the base.

12. The lamp base of claim 1 wherein the at least one raised bead is generally equispaced about the recesses for engaging a press seal of a lamp.

13. The lamp base of claim 1 wherein the at least one raised bead is located in the cavity to restrain a press seal of a lamp against movement in the thickness direction.

14. The lamp base of claim 1 wherein the at least one raised bead is located in the cavity to restrain a press seal of a lamp against movement in both the thickness and width directions.

15. A molded plastic lamp base adapted to receive a press seal of a lamp having predetermined peripheral dimensions, the base comprising:

a unitary, substantially parallelepiped base member open at one end and surrounded by peripheral walls that are substantially identical to the peripheral dimensions of the press seal with an included manufacturing tolerance defining a cavity extending inwardly toward a shoulder, a pair of facing peripheral walls including beads protruding inwardly along a full height of the cavity for frictional engagement with the press seal.

16. The lamp base of claim 15 wherein the facing peripheral walls each include a curvilinear recess adapted to receive an exhaust portion of a press seal.

17. The lamp base of claim 16 wherein the beads are located in the recesses.

18. The lamp base of claim 16 wherein the beads are located closely adjacent the recesses.

19. The lamp base of claim 18 wherein the beads have a semicircular cross-section.

20. The lamp base of claim 18 wherein the beads have a triangular cross-section.

21. The lamp base of claim 15 wherein the beads are located and dimensioned to restrict movement of a lamp base in directions both parallel and perpendicular to the facing walls.

* * * * *